US006237255B1

(12) United States Patent
Renaudin et al.

(10) Patent No.: US 6,237,255 B1
(45) Date of Patent: May 29, 2001

(54) DEVICE FOR ADJUSTING THE DIMENSIONS OF A SHOE, IN PARTICULAR A CHILD'S SHOE AND SHOE EQUIPPED WITH SAME

(75) Inventors: Jean-Pierre Renaudin, Saint-Cloud; Stéphane Maudouit, Le Bouscat, both of (FR)

(73) Assignee: MOD'8, Blanquefort (FR)

( * ) Notice: Subject to any disclaimer, the term of this patent is extended or adjusted under 35 U.S.C. 154(b) by 0 days.

(21) Appl. No.: 09/242,326

(22) PCT Filed: Aug. 12, 1997

(86) PCT No.: PCT/FR97/01479

§ 371 Date: Apr. 5, 1999

§ 102(e) Date: Apr. 5, 1999

(87) PCT Pub. No.: WO98/06286

PCT Pub. Date: Feb. 19, 1998

(30) Foreign Application Priority Data

Aug. 13, 1996 (FR) ..... 96 10282

(51) Int. Cl.[7] ..... A43B 3/26
(52) U.S. Cl. ..... 36/97; 36/112; 36/102
(58) Field of Search ..... 36/88, 97, 102, 36/112, 43

(56) References Cited

U.S. PATENT DOCUMENTS

| | | | | |
|---|---|---|---|---|
| 2,185,995 | * | 1/1940 | Haskell | 36/43 |
| 2,309,673 | * | 2/1943 | Schlear | 36/43 |
| 2,497,175 | | 2/1950 | Mantos . | |
| 2,523,449 | | 9/1950 | Rosenzweig . | |
| 2,734,284 | * | 2/1956 | Seurbom | 36/97 |
| 4,944,099 | * | 7/1990 | Davis | 36/97 |
| 5,325,614 | * | 7/1994 | Rosen | 36/97 |
| 5,404,658 | * | 4/1995 | Rosen | 36/97 |
| 5,813,145 | * | 9/1998 | Prober | 36/93 |

FOREIGN PATENT DOCUMENTS

| | | |
|---|---|---|
| 463456 | 7/1928 | (DE) . |
| 296 04 002 U | 8/1996 | (DE) . |
| 1506981 | 12/1967 | (FR) . |
| 2321248 | 3/1977 | (FR) . |
| WO 90/01275 | 2/1990 | (WO) . |

* cited by examiner

*Primary Examiner*—Paul T. Sewell
*Assistant Examiner*—Jila Mohandesi
(74) *Attorney, Agent, or Firm*—Young & Thompson

(57) ABSTRACT

A device for adjusting at least lengthwise a shoe as a function of growth of the size of the foot of the wearer, the shoe comprising a sole, with a front portion (28) and a rear portion (30), a lower insole (12) and an upper insole (14) and an upper (16) comprising an instep (20) and a rear quarter (22). The instep (20) is secured to the front portion (28) of the sole, the rear quarter (22) is secured to the rear portion (30) of the sole. The sole comprises a region of elongation (24) interposed between the front portion (28) and the rear portion (30) with elements for blocking as to length.

11 Claims, 4 Drawing Sheets

DEVICE FOR ADJUSTING THE DIMENSIONS OF A SHOE, IN PARTICULAR A CHILD'S SHOE AND SHOE EQUIPPED WITH SAME

CROSS REFERENCE TO RELATED APPLICATION

This is the 35 USC 371 national stage of international application PCT/FR97/01479 filed on Aug. 12, 1997, which designated the United States of America.

FIELD OF THE INVENTION

The present invention relates to a device for the lengthwise adjustment and if desired the width of a shoe as a function of growth of the foot for limited values of several sizes, the invention also concerning the shoe thus obtained.

BACKGROUND OF THE INVENTION

The problem arises of useless purchases of shoes or at least the loss of money from them, particularly with the smallest sizes for children. Thus, a pair of shoes bought at the right size for the foot of an infant at a given time, will be too small one month later because for example the growth was somewhat more rapid during a given period. In any case, a child's foot grows by one size every three months.

One solution consists of course in getting shoes one or two sizes too large, but such a choice is undesirable because the child is poorly shod which can give rise as is now known to problems at the ankle particularly during the growth period. The effects are not immediately visible but appear with age.

Moreover, the infant will be uncomfortable during a period longer than the period in the course of which the shoe is perfectly fitted, which does not favor learning how to walk, for example.

Another problem also relates to the quality and sale. Parents which must regularly change the shoes of an infant are inclined toward those of low price. As the quality is generally proportional to the price, the foot can suffer from such shoes.

Purchasing a pair of high quality shoes can be envisaged by the parents more readily if the shoes remain usable for a long time. This fully justifies the present invention, which provides a shoe which can be lengthened and to if desired widened to cover at least one additional size.

There are known inventions which disclose means to adjust certain elements of a shoe, particularly U.S. Pat. No. 4,944,099 which provides giving a certain extensibility in length to a shoe. The style described could hardly be considered to be a shoe, because it comprises only an instep and an upper, independent of each other, connected by elastic lateral elements, but this application must be considered as forming a part of the prior art showing the need, even though it is not relevant to the present invention.

The sole comprises two separate and independent portions, secured respectively to the instep and the upper and connected by the cross member of elastic material so as to render the sole monolthic.

The wearer can thus slip on this shoe by compensating very slightly small variations in length, whilst having to put up with the corresponding compression due to the powerful elastic element, which is impossible to envisage for infants.

A modification provides a complete upper but the cutout is provided with an elastic filament, which is prejudicial to a good support of the foot and to permitting the creation of a closed shoe.

There is also known from U.S. Pat. No. 5,163,237 an assembly of insoles of variable height, combined with an internal envelope which is sewn to at least the edge of the shoe. This envelope comprises a portion which is trapped below at least one of the insoles. According to the number of insoles stacked below the envelope or above it, the interior volume can be varied according to the soles which are all above the envelope or all below or else connected on opposite sides of this envelope.

If this description discloses means to adjust in volume a portion of the shoe, more particularly a moccasin, which is to say a shoe without laces, there is provided no means to vary the length and/or width of the shoe. No means permits the modification in length or width of the sole and much less to vary the length of the assembly of the upper, which is to say the end, the instep and the rear quarter.

Certificate of Utility FR-A-2.660.166 discloses a shoe whose rear quarter is removable to prevent transforming this shoe from a low-cut to a high-cut, particularly applicable to a sport shoe. The rear quarter is fixed by rapid hooking means such as that sold commercially under the mark "Velcro". A supplemental tongue also secures the rear quarter to the instep, this instep being able to mask this tongue.

There is not found in this prior art any indication or means for variation of length and/or width of a shoe.

SUMMARY OF THE INVENTION

The present invention provides a device permitting enlarging a shoe, more particularly a closed shoe, by adjusting the length and if desired the width over values of one or two sizes so as to preserve for the shoe its quality of gripping the foot, its comfort and even its appearance. The application relates more particularly to children and the sizes of the order of 19 to 30 according to the French standard.

To this end, the device for adjustment at least in length of a shoe as a function of the growth of the size of the foot of the wearer, such shoe comprising a sole, with a front portion and a rear portion, a lower insole, an upper insole and an upper comprising an instep and rear quarter, is characterized in that the instep is secured to the front portion of the sole, the rear quarter is secured to the rear portion of the sole and in that it comprises a region of elongation interposed between said front portion and said rear portion with means for fixing the lengths.

These fixing means for the length comprise an insert secured to one of the parts and mounted adjustably in translation relative to the other part.

More particularly, the insert is a T whose crosspiece is secured to the front portion and whose stem is mounted slidably in translation in a recess provided in the rear portion with notched means to immobilize this stem in said recess.

Complementarily, there is provided a lock for the position of the insert in the recess.

More particularly, the region of elongation is a bellows comprising cavities, oriented transversely and filled with a cellular and compressible material, with closed cells.

As to the lower insole, it is secured by cementing or stitching only at its front portion and at its rear portion and this lower insole has a region adjustable in length with transverse cutouts, disposed in opposite alternation in the unsecured region.

According to an improvement, there is provided a region of widening in the front portion of the sole, with an assembly of two transverse rods secured to an eccentric and provided at their ends with a distribution arc, with means for fixing in the defined position.

BRIEF DESCRIPTION OF THE DRAWINGS

The invention will now be described with respect to a particular non-limiting embodiment, with reference to the accompanying schematic drawings, in which the various figures represent.

DETAILED DESCRIPTION OF THE INVENTION

Figure 1:
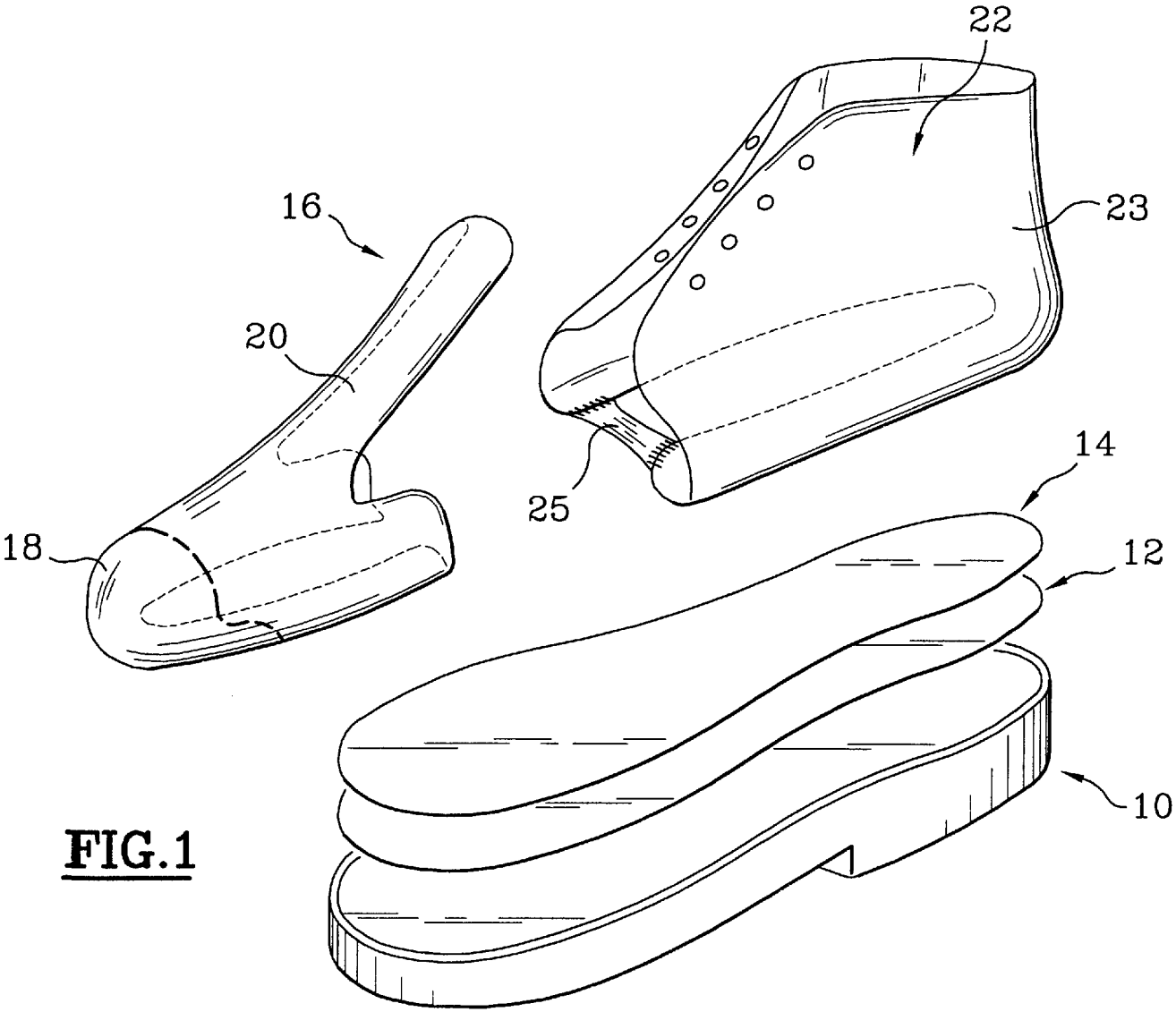
FIG. 1, an exploded perspective view of the different pieces which constitute the shoe, FIGS. 2A and 2B, a view of the shoe assembled according to the invention, in a first position corresponding to the original size and in the second position corresponding to a lengthening of the order of one or two sizes, to give an order of the idea, FIG. 3, a view in longitudinal cross-section showing the two regions of length variation, FIG. 4, a detailed view of the connections to be effected between the various movable and fixed elements, FIG. 5, a detailed perspective view with parts cut away of the length-adjusted means, FIG. 6, a perspective view of a first assembly according to the invention, and FIG. 7 a view from below of the sole portion carrying the width modification means.

In FIG. 1, there is shown in a simplified manner the essential elements which make up the production of a shoe.

The sole 10 is of synthetic material or leather and is adapted to isolate the foot of the wearer from unevenness of the ground.

The lower insole 12 plays the role of shaping during fabrication, ensuring adequate rigidity of each of the regions of the sole and it gives further protection to the foot of the wearer.

The upper insole 14 is on the inside, and directly contacts the foot of the wearer, and has the role of providing comfort and appearance, particularly masking the lower insole as well as the stitching and other possible gluing.

The upper 16 is the essential element of the shoe and the most evident. It comprises a number of pieces determined by the aesthetic shape desired, but generally there will be at least a hard tip 18, an instep 20, a rear quarter 22 and a counter 23, secured to the rear quarter.

Figure 2A:
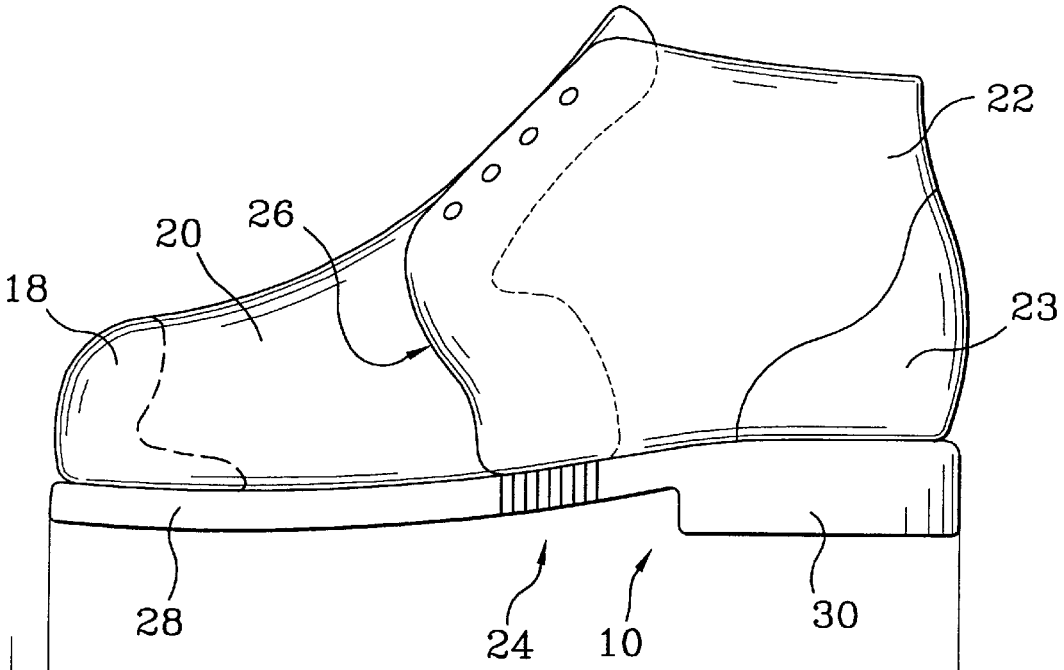
Figure 2B:
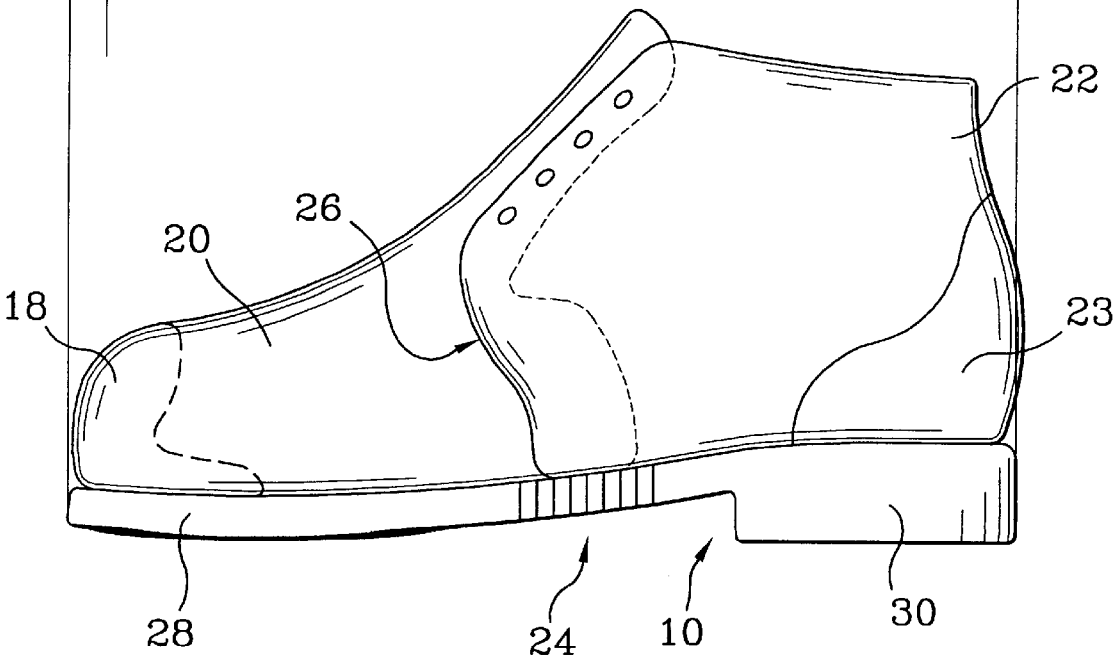

The invention consists, as shown in FIGS. 2A and 2B, in providing a region of elongation 24 in the sole, in line with the region 26 of superposition of the instep 20 and the rear quarter 22. The hard tip and counter are invisible from the outside.

To pass from the condition of the shoe shown in FIG. 2A, the so-called initial condition, to that shown in FIG. 2B, the so-called extended condition, it is also necessary that the upper permit this elongation of the sole.

To this end, the instep 20 and the rear quarter 22 are each secured to a corresponding portion of the sole, which is to say the front portion 28 of the sole for the instep and the rear portion 30 for the rear quarter, which connection is by switching or hot welding, symbolized by a line of connection. The usual connection between the instep and the rear quarter is omitted.

Figure 3:
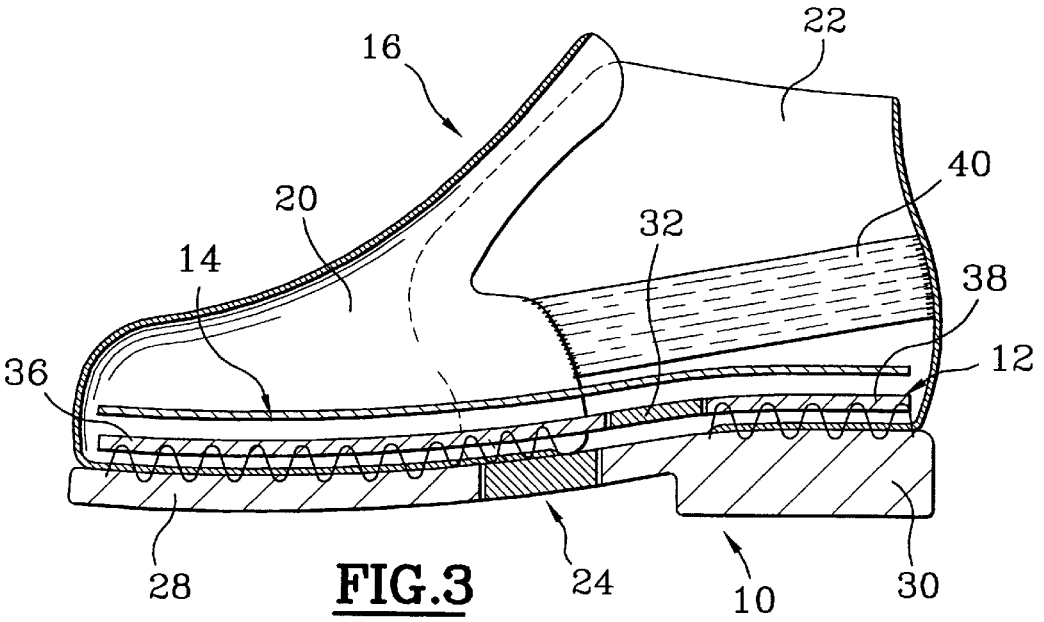

In FIG. 3, there are shown regions in which are provided a connection by gluing or stitching or both, according to the mounting process between the lower insole and the sole. The assembly of the upper on the lower insole and the shaping are generally carried out on a form, prior to securement on the sole.

There remains the problem of increasing in length this lower insole simultaneously with the elongation of the sole, because the lower insole is connected to the upper and this upper is connected to the sole.

Figure 6:
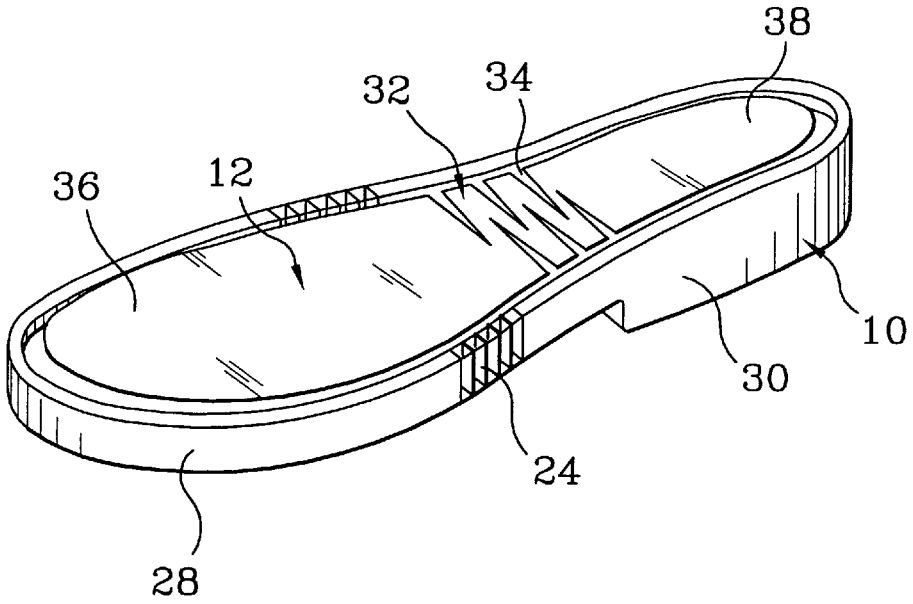

The lower insole 12 is internal and has no role in sealing, as the sole 10 properly so-called. The solution used, in FIG. 6, consists in providing transverse cutouts 34, over a limited region 32 and of a length less than the width of the lower insole so as to keep this lower insole a single piece. These transverse cutouts are arranged in opposite alternation.

During elongation, the cutouts will pull apart to permit this variation of length and to permit following the elongation of the sole.

These cutouts are provided in a region offset relative to the region of elongation 24 of the sole 10, at the back of this region of elongation 24, this placement being dictated by the architecture itself of the assemblage according to the invention.

The limited region 32 should also be maintained free from connections either by gluing or by stitching, as shown in FIG. 3. It will be noted that the lower insole is connected by its forward portion 36 to the instep 20, this assembly being connected to the front portion 28 of the sole, except in line with the region of elongation 24, and by its rear portion 38 to the rear quarter 22, this assembly being connected to the rear portion 30 of the sole.

The upper insole 14 poses no problem in the sense that the variation from one to two sizes does not interfere with the comfort of the wearer.

The rear quarter, in a closed shoe, is secured to the back of the foot by suitable means such as laces generally or tongues with rapid connection such as those sold under the trademark "Velcro".

Referring to FIG. 1, there will be noted a connection 25 which has for its object to secure transversely the free portions of the forward end of the rear quarter in the so-called assemblage region. Also, during a pull on the attachments, the laces for example, the gripping is effective and the front of the quarter will remain pressed against the instep while preventing the traction exerted from raising the edges of said quarter.

So as to render the instep 20 solid with the rear quarter 22, there is provided an elastic strap 40. This strap also plays the role of pressing the edges of the rear quarter against the edges of the instep in the region of superposition, thereby facilitating particularly the introduction of the foot of the wearer.

It will be noted that upon displacement of the instep forwardly, the volume of the shoe increases in line with the foot and the foot is not compressed, which preserves the initial comfort.

Figure 4:
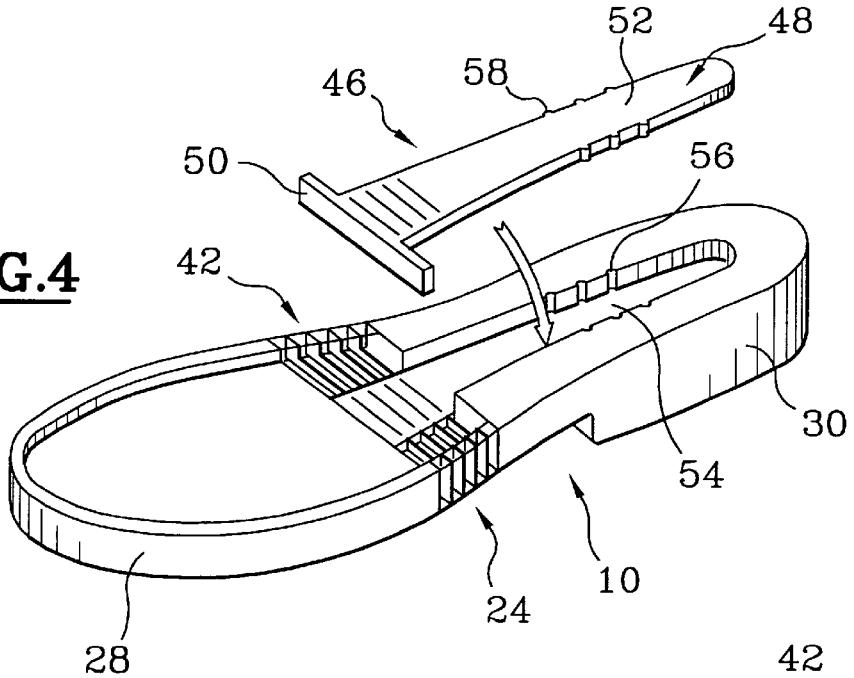
Figure 5:
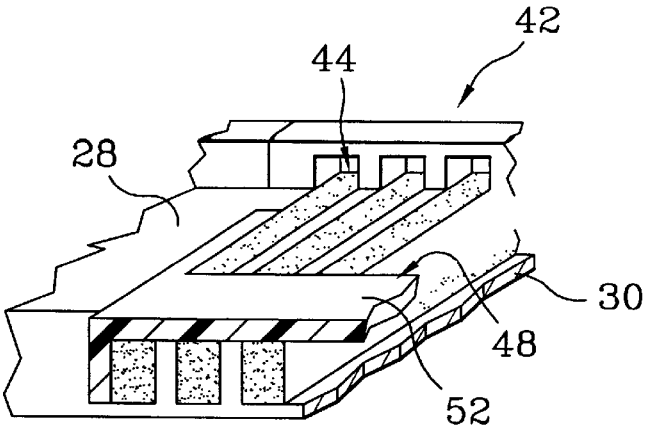

Referring now to FIGS. 4 and 5, these show an embodiment of the elongation region 24.

This elongation region 24 comprises a bellows 42 with recesses 44 filled with foam of a suitable density to be compressible and having closed cells to ensure sealing. This bellows is connected to the front portion 28 of the sole and to the rear portion 30, which renders the sole monolithic.

There is also provided means 46 for blocking in position, after the shoe has been adjusted as to length. These means comprise an insert 48 of T shape. The crosspiece 50 is secured to the front portion 28 and the stem 52 extends into a recess 54 in the medial portion of the rear portion 30. This stem can slide in said recess 54.

Notches 56 are provided in the rear portion 30 of the sole and the insert 48 has projections 58 shaped to coact with the notches.

Preferably, the front portion of the sole is of a material more flexible than the rear portion, for example by modifying its elastomeric properties to permit bending of this front portion as well as in line with the bellows whilst the rear portion remains more rigid as it should.

The hardness of the rear portion permits carrying out notching directly by molding.

It will be noted that the insert is disposed in the medial portion so as to leave free the edges of the sole which receive the returns of the upper and the lower insole.

The assembly of the lower insole and the upper masks the bellows and the insert.

The shoe thus made can be adjusted to the growth in length of the foot of the wearer. It suffices to grip the front portion in one hand and the rear portion in the other and to pull apart or bring together the two portions to increase or decrease the length of the shoe.

The insert 44 moves simultaneously in the recess 54 and the projections 58 cooperate with the notches 56 to hold the lengths. The projections can correspond for example to half sizes.

The bellows 42 ensures sealing against water as well as thermal and mechanical insulation of the foot of the wearer relative to the ground.

The upper lengthens or shortens simultaneously because the rear quarter retreats or advances relative to the instep, the elastic strap 40 ensuring good relative positioning of these two portions of the upper, moreover facilitating putting on the shoe by preventing the shoe from gaping at the junction. This malfunction would not nullify the retention of the shoe but affects the appearance of the shoe.

Preferably, the elastic strap 40 is disposed below the lining of the upper so as to mask it and not give any difficulty to the wearer.

There can be envisaged other means to render adjustable in length the region 24, the embodiment given being one of them but as a function of the designs one skilled in the art could modify this region to keep it effective and to render it aesthetically compatible with the design of the shoe.

It will also be noted, when an adjustment by one size is made, that it is really necessary to consider the neutral condition as a half size. Thus it suffices to compress by one half size to have the smallest size and to extend by one half size relative to this medial position to obtain a total variation of one size.

The lower insole elongated proportionally to the sole because the cutouts pull apart. The spacing of the cutouts in the maximally elongated position remain quite narrow and cutouts are in any case masked by the upper insole, which does not damage the appearance, even when looking into the shoe.

According to an improvement, the insert can comprise a lock disposed transversely, which is within the skill of the art. In this case, it is necessary to make an adjustment simultaneously to the spreading open so as to ensure unlocking of the front and rear portions as for example during transverse movement of the heel from the shoe, which is a natural movement. This permits guaranteeing the position of the insert, particularly for larger shoe sizes, for which the forces involved are greater.

A variation from one to two sizes remains the maximum envisagable in any case, which corresponds substantially to values of elongation from 6.6 to 13.2 millimeters. Beyond that, the appearance of the shoe is affected and the distribution of the volumes of the shoe is offset relative to the foot of the wearer.

On the contrary, according to an improvement of the invention, there can be envisaged a variation of width even if the needs are much less limited than as to length.

In the front portion, for example according to an embodiment similar to that which has been described, it suffices to provide a bellows as for the rear portion 30, but this time the cavities are oriented longitudinally. An insert, whose stem is oriented transversely, is able to ensure blocking in the required width.

Figure 7:
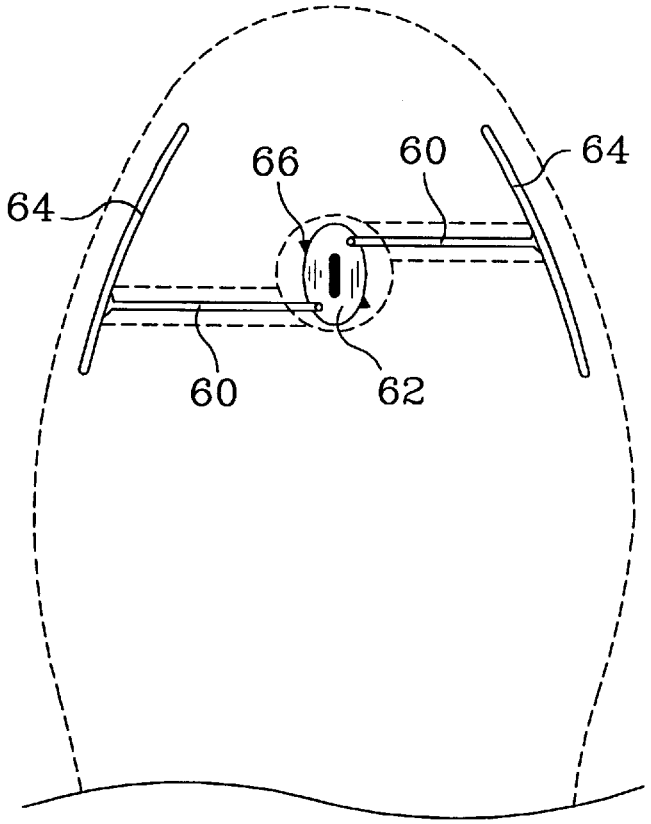

There can thus be foreseen a modification as shown schematically in FIG. 7, in which the means for width adjustment comprise two rods 60, embedded in the sole, secured to an eccentric 62 mounted rotatably and accessible from below the sole. These two rods each carry at their free end a distribution arc 64. There is provided notching 66, to block in rotation this eccentric and to immobilize the rods and hence the arcs in one of the positions. It will be noted that as to width, the values of variation are less.

This invention has for its object to permit following the growth of the foot, more particularly of an infant, so as to render quality footwear accessible to a greater number for evident reasons of health, thanks to a longer period of amortization.

What is claimed is:

1. An adjustable monolithic sole extending in a longitudinal direction, and comprising:

a front region;

a rear region;

an intermediate region interposed between said front region and said rear region, and displaceable in said longitudinal direction; and an insert connecting said front region and said rear region, and structured and arranged to permit movement of the sole and then fix its length in order to maintain the front and rear regions in a desired position; said insert having a T-shape, including a crosspiece and a stem, said crosspiece being secured to the front region, and said stem being mounted slidably in translation in a recess disposed in the rear region; and means for immobilizing said stem in said recess.

2. The monolithic sole according to claim 1, further comprising a lock in position for the insert in the recess.

3. The monolithic sole according to claim 1, wherein the intermediate region is a bellows comprising cavities oriented transversely to the longitudinal axis, and filled with foam of a suitable density to be compressible and having closed cells.

4. The monolithic sole according to claim 1, wherein the front region comprises an assembly of two rods directed transversely to the longitudinal axis, each of said rods having a first end secured to an eccentric, and a second end secured to a distribution arc; said eccentric having means for blocking in the width of the sole in a given position.

5. A shoe with a device for adjusting at least the length of the shoe as a function of growth in size of a foot of a wearer, the shoe comprising:

an instep;

a rear quarter;

an upper;

an adjustable monolithic sole extending in a direction of a longitudinal axis; said sole comprising a front region; a rear region; an intermediate region interposed between said front region and said rear region, and displaceable in said longitudinal direction; and an insert connecting said front region and said rear region, and structured and arranged to permit movement of the sole and then fix its length in order to maintain the front and rear regions in a desired position; said insert having a T-shape, including a crosspiece and a stem, said crosspiece being secured to the front region, and said stem being mounted slidably in translation in a recess disposed in the rear region; and means for immobilizing said stem in said recess.

6. The shoe according to claim 5, further comprising a lock indposition for the insert in the recess.

7. The shoe according to claim 5, wherein the intermediate region is a bellows comprising cavities oriented transversely to the longitudinal axis, and filled with foam of a suitable density to be compressible and having closed cells.

8. The shoe according to claim 5, further comprising a lower insole having a front portion, a rear portion, and an intermediate portion interposed between the front and rear portions; said lower insole being secured to the instep by said front portion, and being secured to the rear quarter by said rear portion; said intermediate portion being displaceable in said longitudinal direction, and having cutouts transverse to said longitudinal direction, disposed in alternate opposition.

9. The shoe according to claim 8, wherein the intermediate portion of the lower insole is positioned rearwardly of the intermediate region of the sole.

10. The shoe according to claim 5, further comprising an elastic strap securing the instep to the rear quarter.

11. The shoe according to claim 5, wherein the front region comprises an assembly of two rods directed transversely to the longitudinal axis, each of said rods having a first end secured to an eccentric, and a second end secured to a distribution arc; said eccentric having means for blocking in the width of the sole in a given position.

* * * * *